US006438788B1

(12) United States Patent
Gartner

(10) Patent No.: US 6,438,788 B1
(45) Date of Patent: Aug. 27, 2002

(54) ROLLER CAGE ASSEMBLY

(75) Inventor: Perry Gartner, Englewood, NJ (US)

(73) Assignee: Brenner International Corp., Englewood, NJ (US)

( * ) Notice: Subject to any disclaimer, the term of this patent is extended or adjusted under 35 U.S.C. 154(b) by 0 days.

(21) Appl. No.: 09/682,424

(22) Filed: Aug. 31, 2001

(51) Int. Cl.[7] ..... B05C 17/02
(52) U.S. Cl. ..... 15/230.11; 492/13
(58) Field of Search ..... 15/230, 230.11; 492/13, 17–19

(56) References Cited

U.S. PATENT DOCUMENTS 2,766,473 A * 10/1956 Thackara
2,891,301 A * 6/1959 Conklin
3,060,555 A * 10/1962 Kirshenbaum et al.
4,541,140 A * 9/1985 Allison
5,490,303 A * 2/1996 Graves

* cited by examiner

*Primary Examiner*—Terrence R. Till
(74) *Attorney, Agent, or Firm*—Richard A. Joel, Esq.

(57) ABSTRACT

A roller assembly to support point rollers comprises a cage mounted on a roller shaft having spaced elongated bars integrally supported by dual flange support members at intervals therealong and terminating in end portions that engage an inner end cap and an outer end cap. The inner end cap includes outer tapered fingers, which engage and hold a paint roller for ease of insertion and removal.

5 Claims, 2 Drawing Sheets

ROLLER CAGE ASSEMBLY

BACKGROUND OF INVENTION

This invention relates to paint rollers and cage assemblies and particularly to a novel assembly that securely fastens the roller cover in place and yet permits the roller cover to be quickly and easily removed. Tapered prongs on the inward end cap facilitate insertion of the roller cover and maintain the roller cover in position during use. The inward cap is force fit on one end of the cage while the outward end cap is fixedly secured to the other end of the cage.

In the prior art, paint rollers often become loose during use. If an attempt is made to secure the roller to an inner cage, it is often difficult to dislodge the roller after use. This invention solves this problem with its unique cage and end cap structure which facilitates installation of the roller, maintains, the roller in position during use and permits removal of the roller.

In the prior art, patent 5,345,648 is directed to a paint roller, which uses a Belleville type spring washer to hold the roller in position on a particular cage design. This design is more expensive and more complicated than the present invention. The proposed invention is easy to use, inexpensive and superior to prior art devices.

Other patents exist in this crowded art but do not affect the patentability of the invention.

SUMMARY OF INVENTION

This invention relates to plastic cage frame assemblies for paint rollers. A roller is mounted over a cage frame which includes a central axial metal shaft extending between an inboard end cap and an outboard end cap, said shaft comprising an outer end portion of the handle shaft. The other end of the handle shaft is perpendicular to the midpoint of the axial shaft and includes a handle mounted thereon. The roller cage comprises opposite end portions, which fixedly engage the respective end caps at a predetermined distance from the axial shaft. A plurality of spaced plastic bars extends axially parallel to the axial shaft between the end caps. The axial bars are spaced at 90° intervals about the periphery of the cage and are joined by circular support members along their length and by end members at each end.

End caps engage the end members to confine the cage in place. The inboard end cap includes an outer flange leading to a recessed cylindrical portion having a plurality of tapered gripping members at the inner end thereof. The gripping members engage the roller, which is slid over the cage between the end caps. This design securely fastens the roller to the cage and permits the roller to be quickly and easily removed after use.

Accordingly, an object of this invention is to provide a new and improved roller assembly for painting.

Another object of this invention is to provide a new and improved rotational roller cage assembly to engage and hold paint rollers.

A further object of this invention is to provide a new and improved roller cage assembly for painting that includes an inboard end cap having a plurality of spaced tapered gripping members to facilitate engagement and disengagement of a paint roller.

A more specific object of this invention is to provide a new and improved paint roller and cage assembly which includes a cage having a plurality of spaced axial bars joined by circular support members at various positions along their length, end portions engaging a centrally located axial shaft, and an inboard end cap mounted to a first cage end having tapered gripping members to engage and hold the roller and an outer end cap fixedly mounted to a second cage end portion.

BRIEF DESCRIPTION OF DRAWINGS

The above and other objects and advantages of this invention may be more clearly seen when viewed in conjunction with the accompanying drawings wherein.

Detailed Description

Figure 1:
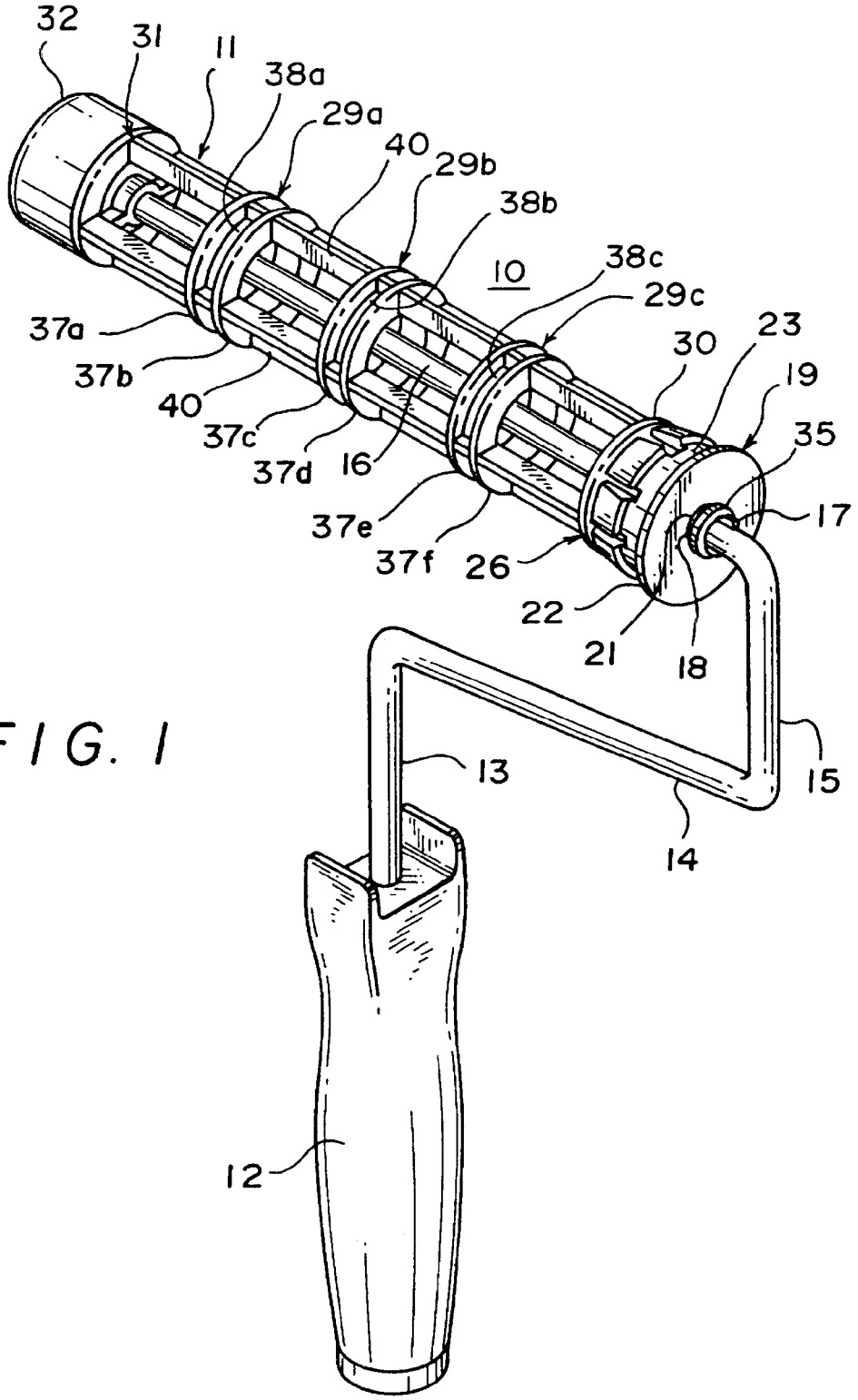
FIG. 1 is a perspective view of the roller cage assembly comprising the invention.
Figure 2:
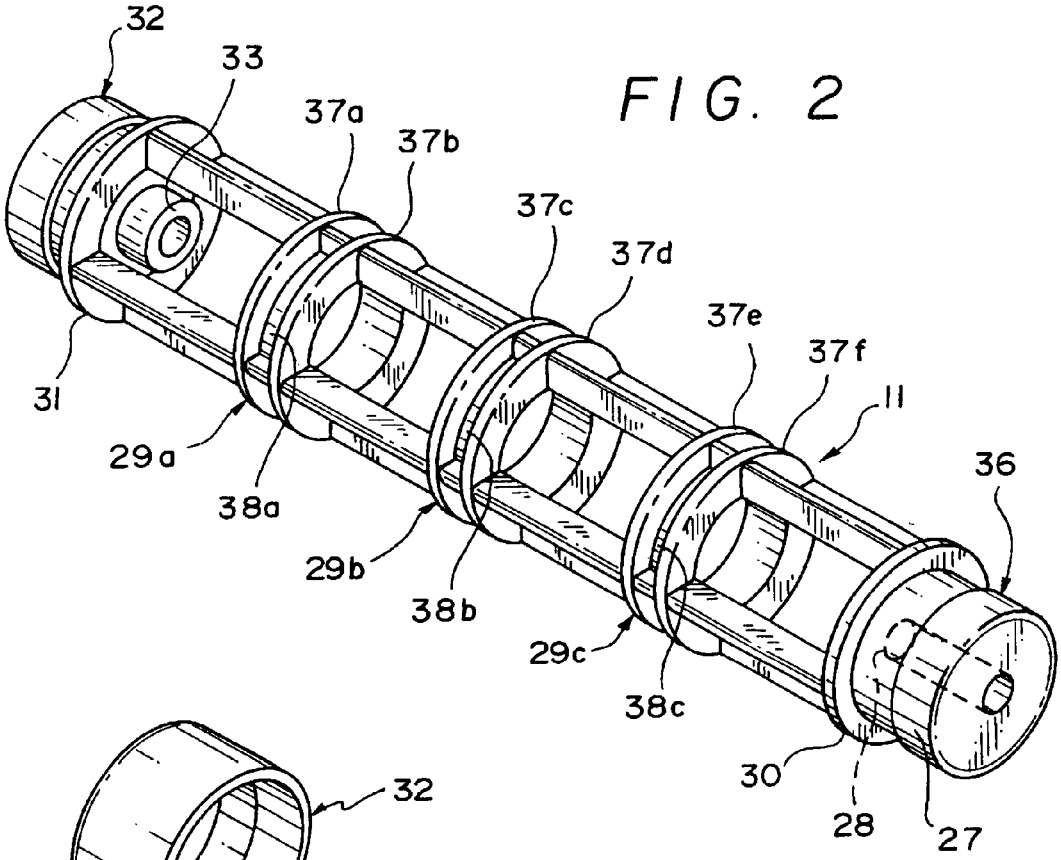
FIG. 2 is a perspective view of the roller cage.
Figure 4:
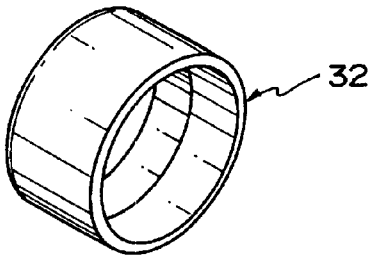
FIG. 4 is a perspective view of the inner end cap.
Figure 3:
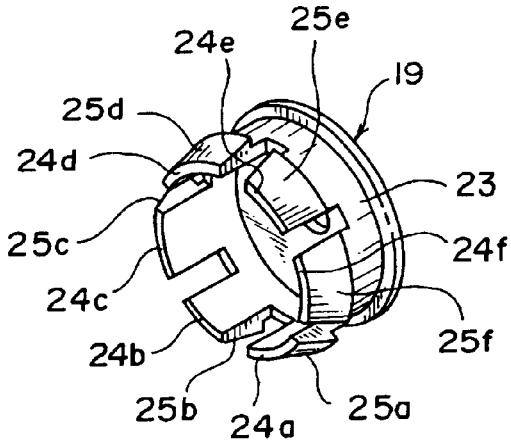
FIG. 3 is a perspective view of the outer end cap.

Referring now to the drawings, FIG. 1 discloses a perspective view of the invention which comprises a paint roller assembly 10 with a unique cage assembly 11. The roller assembly 10 includes a handle 12 having a metal shaft portion 13 extending outwardly therefrom, a shaft portion 14 at a right angle thereto and a further shaft portion 15 extending outwardly substantially parallel to the handle 12 and portion 13. A final shaft portion 16 extends at a right angle to shaft portion 15 to engage the cage assembly 11 and is substantially parallel to shaft position 16 and a t a spaced distance therefrom.

A stop 17, washer 35, and bearing 18 are located on the inboard end of shaft portion 16. An inboard plastic end cap 19 includes a central aperture 21 to engage the shaft 16 and bearing 18. The end cap 19 is held in position by the stop 17, which engages washer 18. The end cap 19 includes an outer flange 22, an intermediate recessed cylindrical portion 23 and a plurality of spaced gripping members 24 at the inner end thereof. The members 24 extend outwardly from the cylinder portion 23 and then each taper downwardly along surface 25 to the end of said members 24.

Typically six gripping members 24 would be used.

The cage 11 includes inner end portion 36 with an outwardly extending flange 30 and an end cylindrical portion 27 mounted within the end cap 19. The end portion 36 has a central aperture 28 having bearing 18 located therein. A plurality of support members 29*a*–29*c* are located at intervals along the cage 11 while flange portions 30 and 31 are located at opposite ends of the cage 11. Members 29*a–c* include a double flanged construction which engage four parallel axial bars 40 spaced at 90° intervals about the cage 11 parallel to the central shaft portion 16. The double flange construction comprise circular flanges 37*a*–37*b*, 37*c*–37*d*, 37*e*–37*f* each joined by a cross portion 38*a*, 38*b* and 38*c*. The end cap 32 is cylindrical in configuration and engages the shaft 16 which extends through aperture 33 mounted therein. The end cap 32 is fixedly mounted to the cage 11 although in an alternate embodiment, the end caps 19, 32 may rotate independent of cage 11.

In use, a roller (not shown) is slid over the cage assembly 11 against the flange 22 on the end cap 19. The gripping members 24 engage the interior of the roller to hold it securely in position. The roller 10 is thus easily mounted and removed but is held securely in place during use by the tapered gripping members 24, the cage 11 and supporting bars 40 and members 29*a–c*. The roller cage assembly is free to rotate the shaft portion 16.

While the invention has been explained by a detailed description of certain specific embodiments, it is understood that various modifications and substitutions can be made in any of them within the scope of the appended claims that are intended also to include equivalents of such embodiments.

I claim:

1. A roller cage assembly for paint rollers comprising:

a handle having a shaft end extending outwardly therefrom, said shaft having an intermediate portion and another end portion extending perpendicular to the handle;

a cage mounted about the perpendicular shaft end portion having a plurality of spaced elongated bars positioned at intervals about the shaft end portion, a plurality of spaced substantially circular support members engaging the bars each comprising circular double flange portions and circular cross portions joining the double flange portions and an end portion at each end of the cage having an aperture engaging the shaft; and, a first outward end cap mounted at the cage end portion and an inward end cap mounted about the other cage end portion, said inward end cap further including a plurality of outwardly extending tapered fingers to grip a paint roller and an aperture extending therethrough to accommodate the shalt and wherein a paint roller is inserted over the cage.

2. A roller cage assembly for paint rollers in accordance with claim 1 further including:

a projecting stop on the inward end of the shaft end portion and a washer slidably mounted on the shaft adjacent the stop to engage the inner end cap to limit movement of the cage on the shaft.

3. A roller cage assembly for paint rollers in accordance with claim 1 further including:

a bearing mounted in each end cap and end portion to engage the shaft at the inner and outer portions of said shaft to permit rotation of the cage.

4. A roller cage assembly for paint rollers in accordance with claim 1 wherein:

the end portions of the cage each comprise an inner flange and a recessed cylinder extending outwardly from the flange to engage the end caps.

5. A roller cage assembly for paint rollers in accordance with claim 1 wherein:

the cage is plastic; and the cage support members comprise three spaced members integrally molded with elongated bars.

* * * * *